US008859927B2

(12) United States Patent
Anheuer et al.

(10) Patent No.: US 8,859,927 B2
(45) Date of Patent: Oct. 14, 2014

(54) VACUUM SWITCH HAVING FIXED RAIL TERMINALS ON BOTH SIDES

(75) Inventors: Mathias Anheuer, Rosstal (DE); Joerg Dorn, Buttenheim (DE); Andreas Fartuschnja, Reichertshausen (DE); Thomas Kuebel, Erlangen (DE); Peter Lell, Moosburg (DE); Andreas Zenkner, Obermichelbach (DE)

(73) Assignee: Siemens Aktiengesellschaft, Munich (DE)

( * ) Notice: Subject to any disclaimer, the term of this patent is extended or adjusted under 35 U.S.C. 154(b) by 589 days.

(21) Appl. No.: 13/131,430

(22) PCT Filed: Nov. 10, 2009

(86) PCT No.: PCT/EP2009/064906

§ 371 (c)(1),
(2), (4) Date: May 26, 2011

(87) PCT Pub. No.: WO2010/060790

PCT Pub. Date: Jun. 3, 2010

(65) Prior Publication Data

US 2011/0226740 A1 Sep. 22, 2011

(30) Foreign Application Priority Data

Nov. 26, 2008 (DE) ..... 10 2008 059 670

(51) Int. Cl.

| | |
|---|---|
| ***H01H 33/66*** | (2006.01) |
| ***H01H 1/58*** | (2006.01) |
| *H01H 79/00* | (2006.01) |
| *H01H 39/00* | (2006.01) |

(52) U.S. Cl.

CPC ..... *H01H 33/6606* (2013.01); *H01H 79/00* (2013.01); *H01H 39/004* (2013.01); *H01H 1/5833* (2013.01)

USPC ..... 218/140; 218/120

(58) Field of Classification Search

CPC ..... H01H 33/66; H01H 33/662

USPC ..... 218/140, 7, 10, 153, 154, 118–124; 337/30, 114, 157, 401–405

See application file for complete search history.

(56) References Cited

U.S. PATENT DOCUMENTS 3,412,356 A * 11/1968 Van Horssen ..... 337/150
3,636,292 A * 1/1972 Roth ..... 218/118

(Continued)

FOREIGN PATENT DOCUMENTS

CN 1860573 A 11/2006
DE 10207892 B4 2/2004

(Continued)

*Primary Examiner* — Amy Cohen Johnson
*Assistant Examiner* — Marina Fishman
(74) *Attorney, Agent, or Firm* — Laurence A. Greenberg; Werner H. Stemer; Ralph E. Locher

(57) ABSTRACT

The vacuum switch is compact, requires little effort, and provides a reliable current path having a high current-carrying capacity between the terminals of the vacuum switch, particularly at high switch-on speeds. The vacuum switch has a vacuum chamber, in which a vacuum is present and in which a switching contact is arranged. The switching contact includes a fixed contact piece firmly connected to the vacuum chamber and in electrical contact with a fixed contact terminal, and a moving contact piece movably guided relative to the fixed contact piece. The moving contact piece is at a distance to the fixed contact piece in a disconnect position and contacts the latter in a contact position. A drive unit produces a drive movement. A switching mechanism is connected to the drive unit and the moving contact piece and includes a conductor section that is electrically conducting up to the moving contact piece. A connector connects a moving contact terminal electrically to the moving contact piece in the contact position. The connector has a clamping contact, which has an insertion clamping contact piece connected to the conductor section of the switching mechanism and a mating clamping contact piece firmly connected to the vacuum chamber and electrically connected to the moving contact terminal. The insertion clamping contact piece and the mating clamping contact piece are arranged relative to each other such that the insertion clamping contact piece is clamped with the mating clamping contact piece in an electrically conducting manner as a result of the drive movement.

10 Claims, 2 Drawing Sheets

(56) References Cited

U.S. PATENT DOCUMENTS

| | | | | |
|---|---|---|---|---|
| 4,124,790 | A * | 11/1978 | Kumbera et al. | 218/138 |
| 4,684,771 | A | 8/1987 | Wuethrich | |
| 8,232,498 | B2 * | 7/2012 | Gentsch | 218/92 |
| 2001/0025830 | A1 | 10/2001 | Allard et al. | |
| 2004/0164053 | A1 | 8/2004 | Stoving et al. | |
| 2005/0092713 | A1 | 5/2005 | Chyla et al. | |
| 2007/0102269 | A1 | 5/2007 | Hartmann | |
| 2009/0141416 | A1 | 6/2009 | Dommaschk et al. | |
| 2010/0118453 | A1 | 5/2010 | Dorn et al. | |
| 2011/0057762 | A1 | 3/2011 | Burger et al. | |

FOREIGN PATENT DOCUMENTS

| | | | |
|---|---|---|---|
| DE | 102007018344 | A1 | 10/2008 |
| DE | 102007038898 | B3 | 11/2008 |
| EP | 1017142 | A1 | 7/2000 |
| EP | 1139358 | B1 | 10/2005 |
| RU | 2142187 | C1 | 11/1999 |
| WO | 2005034161 | A1 | 4/2005 |
| WO | 2007095873 | A1 | 8/2007 |
| WO | 2008125494 | A1 | 10/2008 |
| WO | 2009021882 | A1 | 2/2009 |
| WO | 2009092621 | A1 | 7/2009 |

* cited by examiner

VACUUM SWITCH HAVING FIXED RAIL TERMINALS ON BOTH SIDES

BACKGROUND OF THE INVENTION

Field of the Invention

The invention relates to a vacuum switch having a vacuum chamber in which there is a vacuum and in which a switching contact is arranged, with the switching contact being a stationary contact piece which is fixedly connected to the vacuum chamber and makes electrical contact with a stationary contact connecting terminal, and having a moving contact piece, which is guided such that it can move with respect to the stationary contact piece, is arranged at a distance from the stationary contact piece in a disconnected position, and makes contact with the stationary contact piece in a contact position, a drive unit for production of a drive movement, a switching mechanism which is connected to the drive unit and to the moving contact piece and has an electrically conductive conductor section which extends to the moving contact piece, and connecting means, which electrically connect a moving contact connecting terminal to the moving contact piece in the contact position.

A vacuum switch such as this is already known from practical use. Vacuum switches are used, in particular, at medium voltage, that is to say in a voltage range between 1 kV and 52 kV. Particularly when switching high power levels, arcs which are struck when the switching contacts are disconnected occur even in this voltage range. In order to quench these arcs at a current zero crossing, the switching contacts are arranged in a vacuum chamber, in which there is a vacuum. According to the prior art, a stationary contact, which is fixedly connected to the vacuum chamber, and a moving contact, which is guided such that it can move with respect to this, are generally provided. The moving contact may be in the form not only of a switching blade which can pivot but also in the form of a linear-movement contact, which is opposite the stationary contact in a longitudinal direction and is guided such that it can move in this longitudinal direction. In order to allow the moving contact to move in the longitudinal direction, and at the same time to allow a vacuum-tight connection to the vacuum chamber, a bellow composed of metal is provided, which is connected on one side to the vacuum chamber, and on the other side to the moving contact piece. The drive movement of the vacuum switch is produced by a drive unit which, for example, is in the form of a spring storing drive or a magnet drive. The drive movement produced by the drive unit is introduced into the moving contact piece via a switching mechanism. The switching mechanism comprises said switching rod, which has a conductive section which extends to the moving contact piece. Connecting means are provided for electrical connection of this conductive section of the switching rod to a moving contact connecting terminal and, according to the prior art, are in the form of a sliding contact, a strip contact or a rolling contact. A strip contact is generally used, which has a flexible electrically conductive strip section, in order to allow movement of the switching rod. When the vacuum switch is in the contact position, the current flows from the stationary contact connecting terminal via the stationary contact piece, the moving contact piece, the electrically conductive section of the switching rod and the flexible connecting means to the moving contact connecting terminal. However, the flexible connecting means have the disadvantage that they cannot carry as much current as the rest of the components in the current path, as a result of which, particularly in the event of high short-circuit currents, this results in a high resistance which is no longer compatible with many applications. Furthermore, a complex connecting technique for the flexible connecting means is required for high switching speeds, since fast switching results in high friction or bending forces. Finally, flexible connecting means are voluminous.

Furthermore, conical contacts are known from the prior art. According to the prior art, conical contacts are used for switches having two contact arrangements. When the switch is switched on, the conical contact, for example, closes first of all, thus resulting in the expected arc on the conical contact. The second contact arrangement lags behind the contact arrangement which closes first, thus allowing it to be closed without any arc being formed. Because of its better conductivity, the current flows via the lagging second contact arrangement when both contacts are closed. However, this avoids damage to the second contact arrangement resulting from the arc.

BRIEF SUMMARY OF THE INVENTION

The object of the invention is to provide a vacuum switch of the type mentioned initially, which is compact and simple and, particularly for high switching-on speeds, provides a reliable current path with a high current carrying capability between the connecting terminals of the vacuum switch.

The invention achieves this object by the connecting means having a terminal contact which has an insertion clamping contact piece, which is connected to the conductor section of the switching mechanism, and a mating clamping contact piece, which is fixedly connected to the vacuum chamber, and is electrically connected to the moving contact connecting terminal, which contact pieces are arranged with respect to one another such that the insertion clamping contact piece is electrically conductively clamped to the mating clamping contact piece as a consequence of the drive movement.

According to the invention, a vacuum switch is provided which has a terminal contact instead of the normal connecting means. The terminal contact makes it possible to provide a vacuum switch with an exclusively fixed rail. The switching mechanism therefore has no flexible conductor section, rolling contacts or sliding contacts, which can cause mechanical problems when the switching contact is closed quickly. According to the invention, it is therefore possible to close the vacuum switch quickly.

Furthermore, the vacuum switch is also compact and can also be used without problems in small installation areas. According to the invention, the terminal contact has two contact pieces. The mating clamping contact piece of the terminal contact is mechanically fixedly connected to the moving contact connecting terminal, and is therefore arranged in a fixed position. The second contact piece of the terminal contact, specifically the insertion clamping contact piece, is fitted fixedly to the switching mechanism, with an electrical connection being made between the electrically conductive conductor section and the insertion clamping contact piece. This results in the moving contact piece also being electrically connected to the insertion clamping contact piece. At the latest when the switching movement into the switching mechanism is started, the electrical connection is made between the insertion clamping contact piece and the mating clamping contact piece, therefore making an electrical connection between the moving contact piece and the moving contact piece connecting terminal. Flexible connecting means are avoided, according to the invention.

Advantageously, the terminal contact leads the switching contact in time during closure of the vacuum switch. This advantageous further development ensures that no arc occurs outside the vacuum chamber. The insertion clamping contact piece is therefore expediently connected to the switching mechanism such that the moving contact piece is braked during clamping of the contact pieces of the terminal contact. According to this expedient further development of the invention, the impact with the stationary contact piece is therefore considerably less powerful.

According to one preferred refinement of the invention, the drive unit is a pyrotechnic force element, and an ignition circuit for initiation of the pyrotechnic force element is provided. Pyrotechnic force elements allow the vacuum switch to be closed particularly quickly. The ignition of the pyrotechnic force element furthermore produces high switching-on forces, resulting in a powerful impact with the moving contact piece. Within the scope of the invention, the switching contact can also become wedged as a consequence of the high impact forces. The vacuum switch can therefore be switched only once, and must then be replaced.

According to one further development which is expedient in this context, the pyrotechnic drive has a moving element which is moved explosively through a movement distance as a consequence of the initiation. In this case, the switching mechanism is in the form of a switching rod which extends in a longitudinal direction and is connected to the moving element, with the moving element being designed to hold the moving contact piece in its disconnected position until initiation of the pyrotechnic drive. According to this expedient further development, the switching contact is in the form of a so-called linear movement contact. In other words, the moving contact is held at the end of a switching rod which projects into the vacuum chamber. In this case, the moving contact piece is opposite the stationary contact piece in the longitudinal direction, in which the switching rod also extends. The pyrotechnic drive is located at that end of the switching rod which is remote from the moving contact piece, with the switching rod being mechanically connected to the moving element which, for example, is in the form of a pin and is arranged aligned with the switching rod. The pyrotechnic drive is aligned such that the moving element can be moved in the longitudinal direction toward the stationary contact when the pyrotechnic force element is ignited. The rigid connection between the moving element and the moving contact piece by means of the switching rod results in the moving contact piece being moved in the direction of the stationary contact piece. In the process, the insertion clamping contact piece is at the same time pressed into the mating clamping contact piece, thus closing the current path between the connecting terminals of the vacuum switch. Before ignition of the pyrotechnic force element, the moving element provides a holding force, which opposes the closure of the switching contact. A progressive closing force acts because of the pressure difference in the interior of the vacuum chamber and the outside atmosphere, and this drives the moving contact piece toward the stationary contact piece. This is opposed by the holding force of the moving element.

According to one further development, which is expedient in this context, positioning means are provided for adjustment of the physical position of the moving element, and therefore of the distance between the moving contact piece and the stationary contact piece. By way of example, positioning means such as these are simple positioning screws, which make it possible to vary the position of the pyrotechnic drive unit, and therefore of the moving element, in a common holding frame.

According to one preferred refinement, the terminal contact is a conical contact and has a conical clamping-in contact piece and a mating clamping contact piece whose shape is complementary thereto. The clamping-in contact piece is, for example, a ring which is fitted to the cylindrical switching rod and whose circumference increases continuously in the opposite direction to the switching movement, thus providing a clamping-in contact piece with a wedge-shaped cross section, through whose concentric cavity the switching rod extends. According to one preferred refinement, the clamping-in contact piece is arranged loosely on the switching rod, resulting in the clamping-in contact piece being seated clamped on the switching rod when the switch is switched on. In contrast to this, the insertion clamping contact piece may, however, also be fixedly connected to the switching rod, for example by adhesives, welding, screw connection or shrinkage.

According to one advantageous further development, the clamping-in contact piece already rests loosely on the mating clamping contact piece in the disconnected position. This ensures that the terminal contact always leads the switching contact in time.

The stationary contact piece is advantageously held by a contact rod, which passes through a wall of the vacuum chamber and, outside the vacuum chamber, is connected at least mechanically to holding means in order to support the vacuum switch, and is connected at least electrically to contact means which are conductively connected to the stationary contact connecting terminal, with the holding means being connected downstream from the contact means, from the view of the stationary contact piece. According to this advantageous further development, this avoids electrical eddy currents, which can otherwise be observed.

The invention also relates to a converter valve for conversion of an electric current or of an electrical voltage having a series circuit of bipolar submodules, with each submodule having at least one energy store and one power semiconductor circuit, by means of which the voltage which is dropped across the energy store, or a zero voltage, can be produced at the connection of the associated submodule, and with each submodule having associated bridging means for bridging the submodule in the event of a fault.

Converter valves such as these have already been disclosed, with the designation multi-level converters. In particular, converter valves such as these can be successfully used in the field of power transmission and power distribution, as a result of which there is a continuously increasingly demand for converter valves such as these. If one of the submodules in the series circuit becomes faulty, it is worthwhile quickly bridging the submodule, thus allowing the operation of the converter valve to be continued further, using the remaining submodules.

Another object of the invention is therefore to provide a converter valve such as this, which can be bridged safely, reliably and quickly.

The invention achieves this object by bridging means which comprise a vacuum switch of the type mentioned above.

The power semiconductor circuit for production of a voltage at the connecting terminals of each submodule is expediently designed such that it is the inverse of the voltage dropped across the energy store. In other words, the power semiconductor circuit can produce not only the voltage which is dropped across the energy store, for example a capacitor, but also the inverse voltage of this. One precondition for this is that the energy store and the power semiconductor switch form a so-called full-wave bridge circuit, which can also be referred to as an H-bridge. In contrast to this half-wave bridge circuits are also possible within the scope of the invention.

Further expedient refinements and advantages of the invention are the subject matter of the following description of exemplary embodiments of the invention, with reference to the figure of the drawing, in which:

DESCRIPTION OF THE INVENTION

Figure 1:
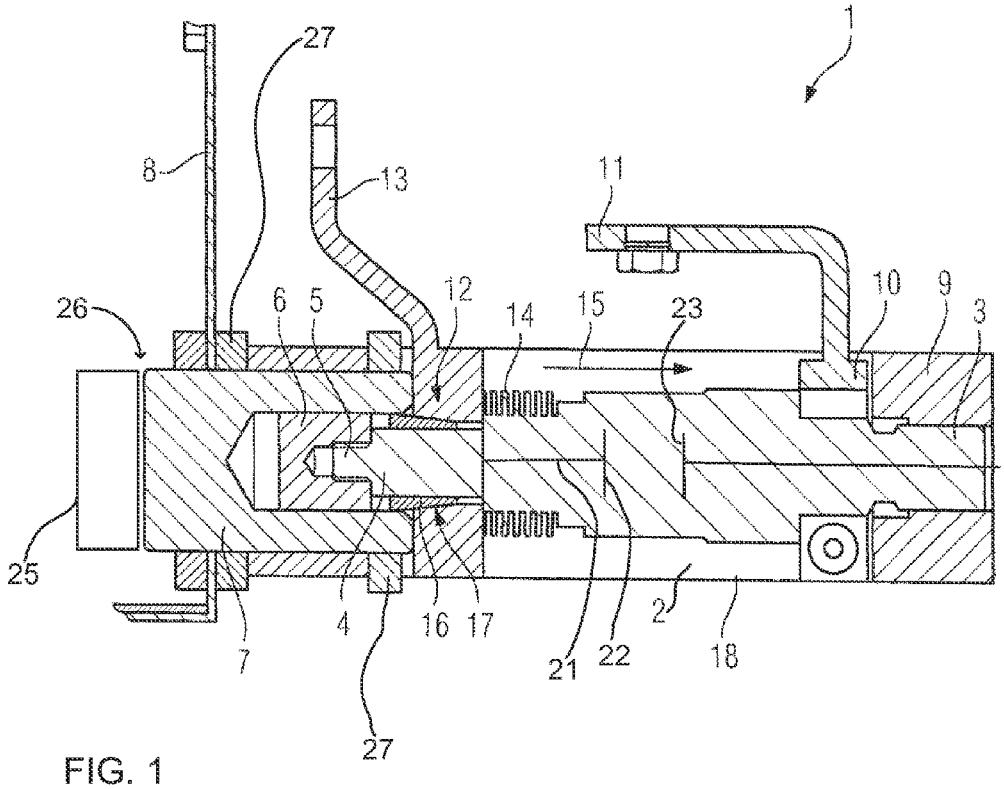
FIG. 1 shows one exemplary embodiment of the vacuum switch according to the invention, in the form of a cross-sectional view.
Figure 2:
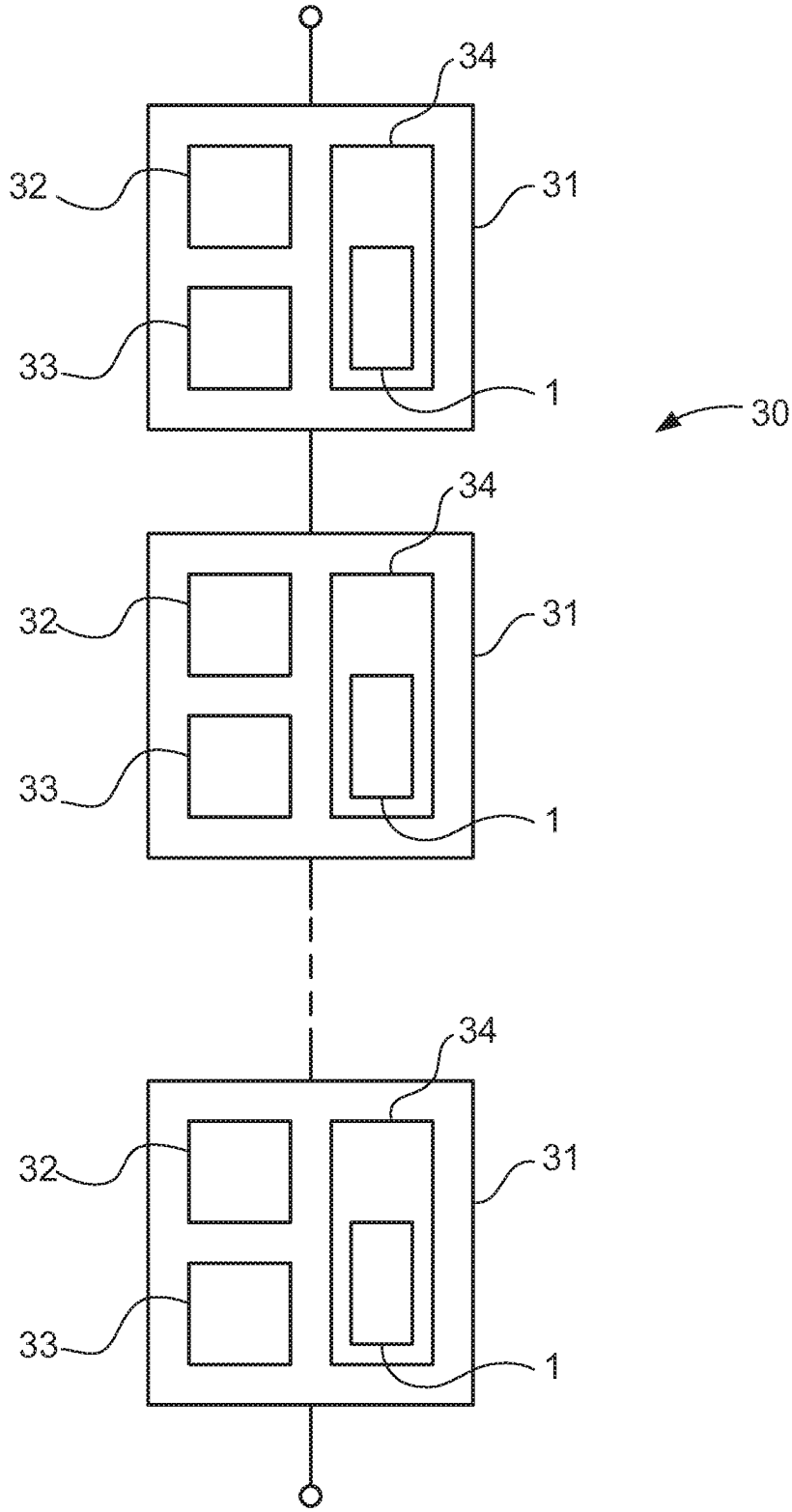
FIG. 2 shows bipolar submodules 30 of identical design connected in series.

The figure shows a cross-sectional view of one exemplary embodiment of the vacuum switch 1 according to the invention. The vacuum switch 1 has a switching contact, which is not illustrated in the figure, in a vacuum chamber 2. The vacuum switching chamber has a ceramic tube, which extends between the contacts and acts as an insulator. A stationary contact bolt 3 projects into the vacuum chamber 2 and is fitted with the stationary contact piece 23, at its end that is arranged in the vacuum chamber 2. The moving contact piece 22 is opposite the stationary contact piece 23 in the longitudinal direction and is supported by the free end of a switching rod 4, which forms the switching mechanism of the vacuum switch 1. At its end 5 remote from the moving contact piece 22, the switching rod 4 is fixedly connected to a moving element 6 of a pyrotechnic drive unit 26. The pyrotechnic drive unit 26 has an ignition circuit 25 for initiation of a pyrotechnic force element 7. positioning means 27 are provided for adjustment of the physical position of the moving element 6, and therefore of the distance between the moving contact piece 22 and the stationary contact piece 23. A holding frame, which is not illustrated in the figure, is used to hold the pyrotechnic drive unit 26. The reference symbol 8 schematically indicates the evaluation electronics of a control unit. A holding strip 18 is used for mechanical connection of the pole heads of the vacuum switch, extends between the pole heads and is composed of an insulating material, for example of a plastic reinforced with glass fibers. Furthermore, the vacuum chamber 2 and the stationary contact bolt 3 are likewise arranged in a fixed position with respect to the supporting frame 8, via holding means 9. Furthermore, contact means 10 ensure that the stationary contact bolt 3 and therefore the stationary contact piece 23 are electrically connected to a stationary contact connecting terminal 11.

In the illustrated exemplary embodiment, the switching rod 4 is completely conductive. A terminal contact 12 is used for electrical connection of the switching rod 4, and therefore of the moving contact piece 22, to the moving contact connecting terminal 13 with a fixed rail. A metal bellows 14, which is indicated only schematically, is used for the longitudinally moving, and at the same time vacuum-tight, connection of the switching rod 4 to the vacuum chamber 2. The terminal contact 12 comprises an insertion clamping contact piece 16 and a mating clamping contact piece 17 whose shape is completing to it. The insertion clamping contact piece 16, is connected to a conductor section 21 of the switching mechanism 4. The insertion clamping contact piece 16 is conical, as a result of which it is shown as a wedge in the illustrated cross-sectional view.

The vacuum chamber 2 illustrated in the figure is used to bridge a submodule of a converter valve, which has bipolar submodules 31 of identical design connected in series 30. Each submodule 31 has at least one energy storage device 32 and one power semiconductor circuit 33. Each submodule 31 has associated bridging means 34 for bridging the respective submodule 31 in the event of a fault. If one submodule 31 becomes faulty, high short-circuit currents occur in the submodule 31, resulting in an arc being formed. The vacuum switch 1 is closed in order to avoid an arc such as this, and in order to maintain the operation of the converter valve with the aid of the undamaged submodules. For this purpose, the short-circuit current is first of all detected by sensors, which are not illustrated in the figure, in the submodule which is arranged in parallel with the vacuum switch 1. In addition to the current flowing in the submodule 31, it is also possible to measure the voltage, and to supply this to said control unit. If a short-circuit criterion which has previously been defined in the control unit is satisfied, the control unit sends an ignition signal to the pyrotechnic force element 7. This leads to explosive movement of the moving element 6, and therefore of the switching rod 4. In the process, the switching rod 4 is moved in the direction of the arrow 15, that is to say in the longitudinal direction. The switching movement also results in the insertion clamping contact piece 16 being clamped firmly to the mating clamping contact piece 17, producing an electrical contact. When the moving contact piece 22 makes contact with the stationary contact piece 23, this closes the current path between the stationary contact connecting terminal 11 and the moving contact connecting terminal 13.

The invention claimed is:

1. A vacuum switch, comprising:

a switching contact disposed in a vacuum chamber subject to a vacuum, said switching contact including:

a stationary contact piece fixedly connected to said vacuum chamber and making electrical contact with a stationary contact connecting terminal; and a moving contact piece movably guided relative to said stationary contact piece between a disconnected position at a spacing distance from said stationary contact piece and a contact position in position in contact with said stationary contact piece;

a drive unit for production of a drive movement;

a switching mechanism connected to said drive unit and to said moving contact piece, said switching mechanism having an electrically conductive conductor section extending to said moving contact piece; and a connector device disposed to electrically connect a moving contact connecting terminal to said moving contact piece in the contact position, said connector device including a terminal contact with an insertion clamping contact piece, which is connected to said conductor section of said switching mechanism, and a mating clamping contact piece, which is fixedly connected to said vacuum chamber, and is electrically connected to the moving contact connecting terminal;

said insertion clamping contact piece and said mating clamping contact piece being arranged with respect to one another to cause said insertion clamping contact piece to be electrically conductively clamped to said mating clamping contact piece as a consequence of the drive movement.

2. The vacuum switch according to claim 1, wherein said terminal contact closes before said switching contact during closure of the vacuum switch.

3. The vacuum switch according to claim 1, wherein said drive unit is a pyrotechnic drive including a pyrotechnic force element and an ignition circuit for initiation of said pyrotechnic force element.

4. The vacuum switch according to claim 3, wherein said pyrotechnic drive has a moving element that is moved explosively through a movement distance as a consequence of the initiation, said switching mechanism is in the form of a switching rod that extends in a longitudinal direction and is connected to said moving element, and wherein said moving element is configured to hold said moving contact piece in the disconnected position until initiation of said pyrotechnic force element.

5. The vacuum switch according to claim 4, which further comprises positioning means for adjustment of a physical position of said moving element, and therefore of a distance between said moving contact piece and said stationary contact piece.

6. The vacuum switch according to claim 1, wherein said terminal contact is a conical contact with a conical clamping-in contact piece and a mating clamping contact piece with a complementary shape.

7. The vacuum switch according to claim 6, wherein said clamping-in contact piece is disposed to already rest loosely on said mating clamping contact piece in the disconnected position.

8. The vacuum switch according to claim 1, which further comprises a stationary contact bolt holding said stationary contact piece, said stationary contact bolt passing through a wall of said vacuum chamber and being connected, outside said vacuum chamber, at least mechanically to holding means supporting the vacuum switch, and connected at least electrically to contact means that are conductively connected to said stationary contact connecting terminal, with said holding means being connected downstream from said contact means, as viewed from the stationary contact piece.

9. A converter valve for conversion of an electric current or of an electrical voltage, comprising:

a series circuit of bipolar submodules, with each submodule having at least one energy storage device and one power semiconductor circuit, by means of which the voltage which is dropped across said energy storage device, or a zero voltage, can be produced at a connection of an associated said submodule;

each said submodule having associated bridging means for bridging the respective said submodule in the event of a fault, said bridging means including a vacuum switch according to claim 1.

10. The converter valve according to claim 9, wherein said power semiconductor circuit is configured to produce a voltage at said connecting terminals of each said submodule, the voltage being the inverse of the voltage which is dropped across the energy storage device.

* * * * *